US011528784B2

(12) United States Patent
Gwarek et al.

(10) Patent No.: US 11,528,784 B2
(45) Date of Patent: Dec. 13, 2022

(54) DOOR FOR A HOUSEHOLD MICROWAVE APPLIANCE

(71) Applicant: BSH Hausgeräte GmbH, Munich (DE)

(72) Inventors: Wojciech Gwarek, Warsaw (PL); Markus Kuchler, Gstadt am Chiemsee (DE)

(73) Assignee: BSH Haugeräte GmbH, Munich (DE)

( * ) Notice: Subject to any disclaimer, the term of this patent is extended or adjusted under 35 U.S.C. 154(b) by 469 days.

(21) Appl. No.: 16/756,501

(22) PCT Filed: Oct. 4, 2018

(86) PCT No.: PCT/EP2018/076949
§ 371 (c)(1),
(2) Date: Apr. 16, 2020

(87) PCT Pub. No.: WO2019/081171
PCT Pub. Date: May 2, 2019

(65) Prior Publication Data

US 2020/0288544 A1 Sep. 10, 2020

(30) Foreign Application Priority Data

Oct. 23, 2017 (DE) ..... 102017218832.4

(51) Int. Cl.
*H05B 6/64* (2006.01)
*H05B 6/76* (2006.01)

(52) U.S. Cl.
CPC ..... *H05B 6/6414* (2013.01); *H05B 6/766* (2013.01)

(58) Field of Classification Search
CPC ..... H05B 6/6414; H05B 6/766
USPC ..... 219/739, 740, 741, 742, 744, 756, 770; 126/198, 200
See application file for complete search history.

(56) References Cited

U.S. PATENT DOCUMENTS

| | | | | |
|---|---|---|---|---|
| 3,177,334 | A * | 4/1965 | Kinkle | F24C 15/04 174/382 |
| 3,679,855 | A | 7/1972 | Binzer | |
| 4,010,343 | A | 3/1977 | Tanaka et al. | |
| 4,292,488 | A | 9/1981 | Birk | |
| 5,981,927 | A | 11/1999 | Osepchuk et al. | |
| 2004/0164075 | A1 | 8/2004 | Henze et al. | |
| 2009/0008386 | A1 | 1/2009 | Louie et al. | |
| 2014/0319276 | A1 | 10/2014 | Yokoi | |

(Continued)

FOREIGN PATENT DOCUMENTS

| | | |
|---|---|---|
| CN | 203442932 U | 2/2014 |
| CN | 203893281 U | 10/2014 |

(Continued)

OTHER PUBLICATIONS

Translarion of JPS 517758U, No Title available, Jan. 20, 1976, Espacenet (Year: 1976).*

(Continued)

*Primary Examiner* — Quang T Van
(74) *Attorney, Agent, or Firm* — Michael E. Tschupp; Andre Pallapies; Brandon G. Braun

(57) ABSTRACT

A door for a household microwave appliance includes a perforated electrically conductive lattice configured to cover a viewing opening of the door and having a plurality of microholes arranged in a regular pattern. The microholes have a rectangular basic shape with rounded corners.

16 Claims, 1 Drawing Sheet

(56) References Cited

U.S. PATENT DOCUMENTS

| | | | | |
|---|---|---|---|---|
| 2017/0188416 | A1 | 6/2017 | Beifuss | |
| 2021/0051774 | A1* | 2/2021 | Jung | H05B 6/763 |

FOREIGN PATENT DOCUMENTS

| | | | |
|---|---|---|---|
| DE | 3923734 | C1 | 8/1990 |
| EP | 0503899 | A2 | 9/1992 |
| GB | 2125732 | A | 3/1984 |
| JP | S50158949 | A | 12/1975 |
| JP | S517758 | U | 1/1976 |
| JP | 2005273977 | A | 10/2005 |
| WO | 2016179317 | A1 | 11/2016 |

OTHER PUBLICATIONS

International Search Report PCT/EP2O18/076949 dated Dec. 18, 2018.
National Search Report DE 10 2017 218 832.4 dated Oct. 1, 2018.

* cited by examiner

DOOR FOR A HOUSEHOLD MICROWAVE APPLIANCE

CROSS-REFERENCES TO RELATED APPLICATIONS

This application is the U.S. National Stage of International Application No. PCT/EP2018/076949, filed Oct. 4, 2018, which designated the United States and has been published as International Publication No. WO 2019/081171 A1 and which claims the priority of German Patent Application, Serial No. 10 2017 218 832.5, filed Oct. 23, 2017, pursuant to 35 U.S.C. 119(a)-(d).

BACKGROUND OF THE INVENTION

The invention relates to a door for a household microwave appliance, having at least one perforated, electrically conductive lattice, in particular metal lattice, which covers a viewing opening of the door and has a plurality of microholes arranged in a regular pattern. The invention also relates to a household microwave appliance with such a door. The invention is particularly advantageously able to be applied to standalone household microwave appliances and ovens with microwave functionality.

For example, U.S. Pat. No. 3,679,855 A, DE 32 31 516 A1 and EP 0 042 616 B1 disclose a door for a microwave appliance, which has a standalone perforated metal lattice, which covers a viewing opening of the door and has a plurality of round holes arranged in a regular pattern.

WO 2016/179317 A1, U.S. Pat. No. 4,010,343 A or EP 2 020 827 B1 disclose a shielding for a viewing opening of a door of a microwave appliance in the form of a metallic mesh.

DE 39 23 734 C1, DE 103 072 17 A1 disclose glass windows for doors of microwave appliances, which are coated with a thin-film shielding e.g. made of aluminum, copper, tin, tin oxide, carbon nanotubes etc.

DE 102 014 23 A1 discloses shielding in the form of an electrically conductive coating in the viewing area, wherein the coating is embodied in a strip-shaped or diamond-shaped manner.

Shield lattices for airplane windows made of metal-coated polyester fibers are known from US 2014/0319276 A1.

EP 0 503 899 B1 discloses a microwave shielding for a viewing opening of a door of a microwave appliance in the form of a layered lattice. The thickness of the lattice amounts to approx. 0.2 micrometers.

Metal lattices mostly used in household microwave appliances have round holes arranged in a triangular pattern, which have a diameter of approx. 1.5 mm and are arranged with a pitch of approx. 2.5 mm.

BRIEF SUMMARY OF THE INVENTION

The object of the present invention is to at least partially overcome the disadvantages of the prior art and in particular to provide a microwave-sealed shielding for a viewing opening of a door of a microwave appliance, which combines a particularly advantageous combination of the properties: preventing an escape of microwave radiation from the viewing opening, keeping the microwave losses in the shielding low and having good optical visibility through the shielding.

This object is achieved in accordance with the features of the independent claims. Advantageous embodiments are the subject matter of the dependent claims, the description and the drawings.

The object is achieved by a door for a household microwave appliance, having at least one perforated electrically conductive lattice, which covers a viewing opening of the door and has a plurality of microholes arranged in a regular pattern, wherein the microholes have a rectangular basic shape with rounded corners.

This door produces the advantage that microwave losses in the shielding are kept particularly low and it is possible to maintain a good level of optical transparency for an observer in a front view and a very good level of attenuation against microwaves being allowed to pass through. In this context, the rounded corners cause an electrical current density induced by the microwaves to be reduced at the corners compared to a pointed or sharp corner, which means that microwave losses are reduced. This also produces the advantage that a reliability of an electrical connection over various regions of the lattice is increased. This in turn prevents an aging-related reduction of the shielding effect.

The rounded corners may also be referred to as defined radii, as the rounding-off is introduced or manufactured with at least one predefined radius.

The perforation of the lattice is brought about by the microholes. Microholes may be understood to mean holes in general which have a width (e.g. represented by a diameter or an edge length) in the sub-millimeter range.

In principle, the lattice may be present as a standalone, e.g. prefabricated lattice.

In one development, the lattice is a metal lattice. The metal lattice may consist entirely of metal, such as steel, aluminum and/or copper etc., or may be metal-coated. For example, the metal may be or contain steel, aluminum and/or copper (e.g. in the form of a mixture or alloy). The use of a metal lattice produces the advantage that the microholes are able to be created with a low manufacturing outlay and in a particularly precise manner. Alternatively, the lattice may consist of carbon nanotubes or another electrically conductive material, e.g. carbon nanotubes, electrically conductive ceramic etc.

The viewing opening of the door may be covered by exactly one lattice or by a plurality of lattices arranged one behind the other. The viewing opening of the door may in particular be covered by two lattices, which for example are arranged on a front side and on a rear side of a viewing pane. If a plurality of lattices are present, then their microholes are advantageously arranged such that they overlap one behind the other, in order to retain a good level of transparency. It is also advantageous if the microholes of a plurality of lattices have the same shape and/or size. It is particularly advantageous if the plurality of lattices have identically shaped and arranged microholes or patterns.

A rectangular basic shape may be understood to mean a shape which is rectangular up until the rounded corners. In one development, the rectangular basic shape is a square basic shape, which enables a particularly even distribution of the current density in the lattice.

In one embodiment, the at least one perforated lattice is a layer applied to a transparent door pane. This makes it possible to provide a particularly thin lattice, in particular metal lattice. A layered metal lattice advantageously consists of aluminum and/or copper or alloys thereof, in order to achieve a particularly low ohmic resistance, which in turn is advantageous for a good level of shielding power and low losses.

In one development, the lattice is present in the form of a printed electrically conductive dye.

In one development, the lattice is a microcontact-printed lattice or has been applied by means of a microcontact printing. The microcontact printing produces the advantage that micrometer-scale patterns are able to be applied to the door pane in a simple manner. This may advantageously be performed without using a cleanroom. It is possible to manufacture multiple identical stamps by means of a single "master" stamp. The stamps are able to be used to manufacture prints many times with very little wear. In addition, only little energy is consumed to manufacture the prints.

In one development, the lattice is a vapor-deposited lattice. In this context, for example, CVD or PVD methods may be used for the application.

In one development, the lattice is a sputtered-on lattice. A magnetron sputtering may be used for the application in this context, for example. The magnetron sputtering may use a guided beam or a mask, in order to apply the lattice.

In the microcontact printing, in particular an electrically conductive pattern is first applied to a door pane, and if required the layer thickness thereof is subsequently increased, e.g. by galvanization without external current. In this context, the materials of the microcontact printing and of the galvanization may be different. In particular, the lattice may practically only consist of the material applied by galvanization.

The door pane may be a glass pane or a plastic pane.

In one embodiment, the predefined radius of the rounded corners lies between 7 micrometers and 15 micrometers. This has emerged as a value range which is particularly advantageous for reducing local current density peaks in the corners and simultaneously for keeping an area of the microholes large for good transparency.

In one embodiment, a cumulative layer thickness of the at least one perforated lattice lies between 2 micrometers and 5 micrometers. This embodiment is based on the observation that a precision of the introduction of the microholes is significantly reduced for layer thicknesses of more than five micrometers. This in turn hinders a targeted, uniform reduction of the current density peaks and may lead to local fluctuations in the optical transparency. On the other hand, it has been shown that for cumulative layer thicknesses of less than two micrometers, the ohmic resistance drops so far that losses in the lattice and/or a leakage of microwaves through the lattice increase significantly.

If exactly one microwave-shielded lattice is present, then a "cumulative" layer thickness is understood to mean its layer thickness. If a plurality of microwave-shielded lattices arranged one behind the other are present on the door in a front view, then the "cumulative" layer thickness is understood to mean the added or common layer thickness of all lattices.

In one embodiment, the at least one perforated lattice is exactly one lattice, the layer thickness of which lies between 2.5 micrometers and 5 micrometers. This produces the advantages for exactly one lattice described above. For a single-layer lattice made of copper, for example, a layer thickness between 2.5 micrometers and 5 micrometers may be particularly advantageous. For a single-layer lattice made of aluminum, for example, a layer thickness of approx. three micrometers may be particularly advantageous.

In one embodiment, the at least one perforated lattice has a plurality of lattices arranged one behind the other on the door in a front view, the cumulative layer thickness of which lies between 2 micrometers and 5 micrometers. This produces the advantages for a plurality of lattices described above. In particular, if two lattices are present, then these may have a layer thickness of one micrometer in each case. Nevertheless, the upper limit of five micrometers is retained, e.g. due to manufacturing tolerances when positioning the lattice on a viewing pane, which may lead to a lateral offset of the lattices in relation to one another, which in turn hinders an optical transparency.

In one embodiment, the microholes are arranged in a rectangular matrix shape. This produces the advantage that particularly low current density peaks can be achieved. A rectangular matrix shape may, in particular, be understood to mean a shape of an arrangement in which the microholes are arranged uniformly along notional rows and columns running at right angles thereto. The microholes of adjacent rows or columns have no longitudinal offset in relation to one another—for example as opposed to a triangular pattern.

The rectangular matrix shape may, in particular, be a square matrix shape, in which a distance between the rows and columns, or the microholes along the rows and columns, respectively, is equal. This advantageously causes a particularly even distribution of the current densities in the lattice.

The particularly even distribution of the current densities in the lattice is also supported by the edges of the microholes in particular running parallel to the rows and columns, i.e. not arranged in the manner of a rhombus in the pattern.

In one embodiment, a width of strip regions of the lattice which delimit the microholes is at least three times, in particular at least four times as great as a thickness of the lattice. This produces the advantage that it is possible to achieve a particularly even width of the strip region of the lattice, which reduces an inhomogeneous current density distribution in the strip regions further still and thus a danger of damage to the lattice. A "strip region" of the lattice may in particular be understood to mean a material strip of the lattice with parallel, straight longitudinal sides, the longitudinal sides of which adjoin the microholes. The width of the material strip corresponds in particular to a following distance between directly adjacent microholes of adjacent rows or columns of the matrix pattern. In a rectangular matrix pattern, the width of the material strips of the columns ("vertical" material strips) and the width of the material strips of the rows ("horizontal" material strips) may be different. In a square matrix pattern, their width is the same.

This embodiment is particularly advantageous in connection with the cumulative layer thickness between 2 micrometers and 5 micrometers, as for greater layer thicknesses and correspondingly enlarged microholes the leakage of microwaves through the lattice increases once more. The reason for this may lie in that a higher conductivity of the lattice is not able to compensate for an increased permeability of the lattice for microwaves due to enlarged microholes.

In one development, a width of the strip regions of the lattice is no more than five times, in particular no more than four times as great as a thickness of the lattice. This produces the advantage that a transparency is particularly high.

In one embodiment, a pitch of adjacent microholes lies between 50 micrometers and 100 micrometers. This embodiment produces the advantage that a particularly advantageous compromise is made between good transparency, low losses and high shielding effect. A "pitch" of adjacent microholes may in particular be understood to mean a center-to-center distance between directly adjacent microholes (i.e. not arranged obliquely in relation to one another). In a rectangular matrix pattern, the pitch along the columns and the pitch along the rows may differ. In a square matrix pattern, their pitch is the same.

In one embodiment, the microholes have an edge length between 30 micrometers and 100 micrometers, in particular between 40 micrometers and 75 micrometers. Such an edge length enables a good level of transparency, in particular across the entire optical spectrum. Lower edge lengths for example may lead to a significant refraction of the light at the edges of the microholes. Higher edge lengths may lead to a loss of the visible homogeneity. An edge length may in particular be understood to mean a full height or width of the microholes.

In one embodiment, the household microwave appliance is a dedicated microwave appliance ("standalone appliance"). In another embodiment, the household microwave appliance is a microwave combination appliance. The microwave combination appliance may in particular be an oven with microwave functionality. The door is then a microwave-sealed oven door.

The object is also achieved by household microwave appliance, which has such a door. The household microwave appliance may be embodied in the same way as the door and has the same advantages.

The object is further achieved by a viewing pane as described above.

BRIEF DESCRIPTION OF THE DRAWINGS

The above-described properties, features and advantages of this invention and the manner in which these are achieved will become clearer and more readily understandable in connection with the following schematic description of an exemplary embodiment, which will be described in further detail making reference to the drawings.

DETAILED DESCRIPTION OF EXEMPLARY EMBODIMENTS OF THE PRESENT INVENTION

Figure 1:
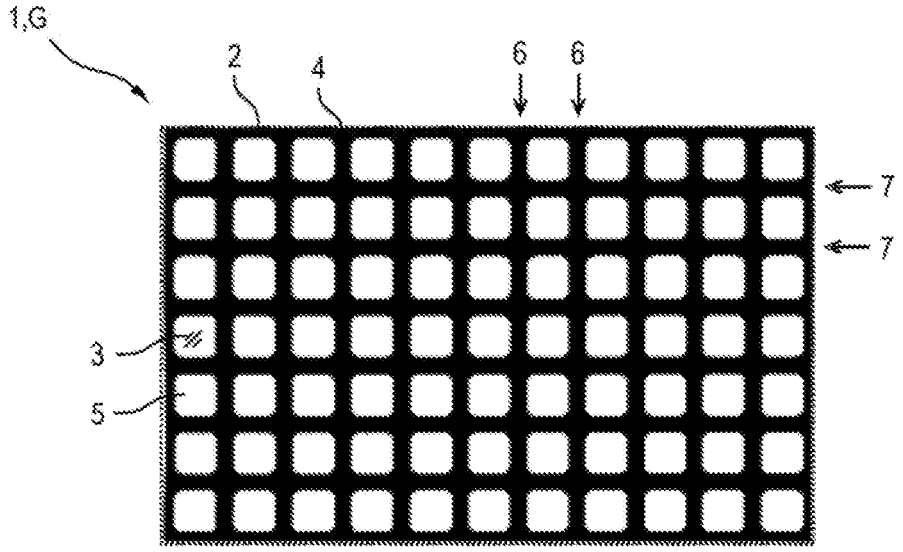
FIG. 1 shows a front view of a cutout of a door according to the invention.

FIG. 1 shows a front view of a cutout of a door 1 according to the invention of a microwave appliance G with a viewing window 2 in the form of e.g. a transparent plastic or glass pane 3, which is coated on a surface with a perforated metal lattice 4 in the form of a layer. The metal lattice 4 may consist of aluminum or copper, for example.

For its perforation, the metal lattice 4 has microholes 5 arranged in a regular square matrix pattern. The microholes 5 have a square basic shape with rounded corners.

Figure 2:
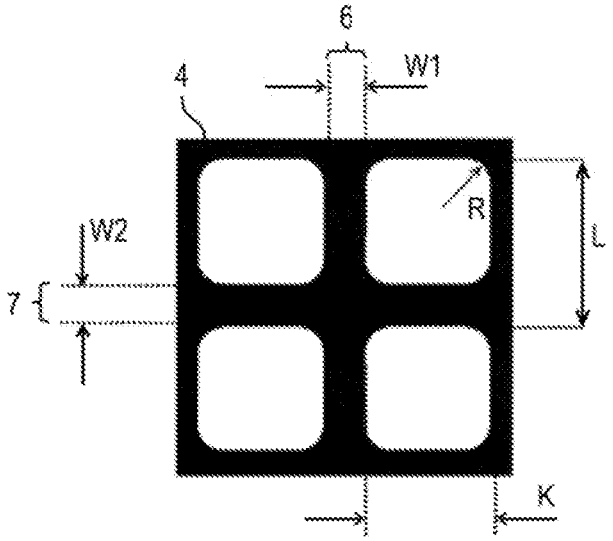
FIG. 2 shows a front view of an enlarged cutout of the lattice of the door from FIG. 1.

The corners have a predefined radius R, as shown in FIG. 2. Here, the radius R amounts to between 7 micrometers and 15 micrometers, while an edge length K of the microholes 5 in particular may lie between 40 micrometers and 75 micrometers. A pitch L of adjacent microholes in particular lies between 50 micrometers and 100 micrometers.

In addition, a width W1, W2 of vertical strip regions 6 and horizontal strip regions 7 of the metal lattice 4 which delimit the microholes 5 is in each case at least three times, in particular four times as great as a layer thickness (extending perpendicular to the sheet plane) of the metal lattice 4, which lies between 2.5 micrometers and 5 micrometers. Here, the widths are the same, but in principle may also be different.

In particular, the following variants of the metal lattice 4 can be used:

| Variant | 1 | 2 | 3 | 4 | 5 |
|---|---|---|---|---|---|
| Pitch L [μm] | 100 | 100 | 65 | 65 | 50 |
| Width W [μm] | 25 | 35 | 20 | 15 | 10 |
| Radius R [μm] | 15 | 15 | 10 | 10 | 7 |

-continued

| Variant | 1 | 2 | 3 | 4 | 5 |
|---|---|---|---|---|---|
| Metal | Al | Al | Cu | Cu | Cu |
| Layer thickness [μm] | 3 | 3 | 5 | 5 | 2.5 |
| Transparency [%] | 54.6 | 40.3 | 45.9 | 57.1 | 62.5 |
| Permeability for microwaves [dB] at 2.45 GHz | −59.6 | −63.9 | −68.3 | −64.5 | −63.8 |

All variants have a transparency (determined as a relationship of a radiated light current compared to a door without lattice 4) of more than 40%, which is considerably better than the 28% achieved by the metal lattices most commonly used. The best shielding of microwave radiation is given by variant 3.

The present invention is of course not restricted to the exemplary embodiment shown.

In general, "a", "an", etc. can be understood as singular or plural, in particular in the sense of "at least one" or "one or more", etc., provided this is not explicitly excluded, e.g. by the expression "exactly one", etc.

A numerical value can also include the given value as a typical tolerance range, provided this is not explicitly excluded.

The invention claimed is:

1. A door for a household microwave appliance, said door comprising a perforated electrically conductive lattice configured to cover a viewing opening of the door and including a plurality of microholes arranged in a regular pattern, said microholes having a rectangular basic shape with rounded corners.

2. The door of claim 1, wherein the lattice is a metal lattice.

3. The door of claim 1, wherein the basic shape of the microholes is square.

4. The door of claim 1, further comprising a transparent door pane, said lattice being configured as a layer applied to the transparent door pane.

5. The door of claim 1, wherein the rounded corners have a predefined radius in a range between 7 micrometers and 15 micrometers.

6. The door of claim 1, wherein the lattice is configured as a layer having a cumulative layer thickness in a range between 2 micrometers and 5 micrometers.

7. The door of claim 1, wherein the lattice is exactly one lattice in the form of a layer having a layer thickness in a range between 2.5 micrometers and 5 micrometers.

8. The door of claim 7, wherein the one lattice includes a plurality of lattices arranged one behind the other on the door in a front view, said plurality of lattices having a cumulative layer thickness in a range between 2 micrometers and 5 micrometers.

9. The door of claim 1, wherein the microholes are arranged in a rectangular matrix shape.

10. The door of claim 1, wherein the lattice has strip regions to delimit the microholes, said strip regions having a width which is at least three times as great as a thickness of the lattice.

11. The door of claim 1, wherein the lattice has strip regions to delimit the microholes, said strip regions having a width which is at least four times as great as a thickness of the lattice.

12. The door of claim 1, wherein adjacent microholes define a pitch in a range between 50 micrometers and 100 micrometers.

13. The door of claim 1, wherein the microholes have an edge length between 30 micrometers and 100 micrometers.

14. The door of claim 1, wherein the microholes have an edge length between 40 micrometers and 75 micrometers.

15. The door of claim 1, wherein the household microwave appliance is a dedicated microwave appliance or a microwave combination appliance.

16. The door of claim 1, wherein the household microwave appliance is an oven with microwave functionality.

* * * * *